United States Patent [19]

Weis et al.

[11] Patent Number: 4,462,287

[45] Date of Patent: Jul. 31, 1984

[54] APPARATUS FOR CULLING CANT ENDS

[75] Inventors: Rudolf R. Weis, Antioch; Rudolph W. Schutz, Walnut Creek, both of Calif.

[73] Assignee: Crown Zellerbach Corporation, San Francisco, Calif.

[21] Appl. No.: 446,302

[22] Filed: Dec. 2, 1982

[51] Int. Cl.[3] ..... B26D 7/18

[52] U.S. Cl. ..... 83/104; 83/80; 83/155; 83/157

[58] Field of Search ..... 83/79, 80, 104, 157, 83/155, 155.1

[56] References Cited

U.S. PATENT DOCUMENTS 3,905,260 9/1975 Nystrand ..... 83/155

3,916,742 11/1975 Biernot ..... 83/104 X

*Primary Examiner*—James M. Meister

*Attorney, Agent, or Firm*—Thomas R. Lampe

[57] ABSTRACT

Apparatus for culling cant ends from a cant including a first conveyor upon which the cant ends are formed and a second conveyor which forms a gap with the first conveyor when the cant ends are positioned for transfer therebetween so that the cant ends will fall through the gap.

3 Claims, 7 Drawing Figures

APPARATUS FOR CULLING CANT ENDS

BACKGROUND OF INVENTION

In the production of roll products such as consumer paper roll products it is conventional practice to produce during manufacturing an elongated roll called a cant which is then cut to form individual roll products, such as paper towels and toilet tissue rolls. It is conventional practice to remove ends from the cant during the cutting operation. Such ends are likely to be somewhat uneven and are prone to damage during preceding operations and a cant normally is longer than the sum of the rolls cut from it.

BRIEF SUMMARY OF THE INVENTION

The present invention relates to an apparatus for automatically culling cant ends from the production line after the roll cutting operation so that such ends will not interfere with the operations carried out downstream. Culling is carried automatically without operator assistance and the apparatus of the present invention insures that the cant ends are completely removed from the vicinity of the cant and the roll products cut therefrom.

The apparatus of the present invention incorporates a first conveyor means for transporting the cant endwise past a cutting station at which location the cant is cut into individual roll segments. A second conveyor means is positioned downstream from the first conveyor means for receiving the roll segments. Means as provided for forming a gap between the first and second conveyor means at the time the cant ends are positioned for transfer from the first conveyor means to the second conveyor means whereby the cant ends will fall through the gap and will not be transferred to the second conveyor means. Such culling operation employs gravity to cull the cant ends, thus avoiding the necessity of employing complex and expensive positive displacement mechanisms to remove the cant ends.

DETAILED DESCRIPTION

Figure 1:
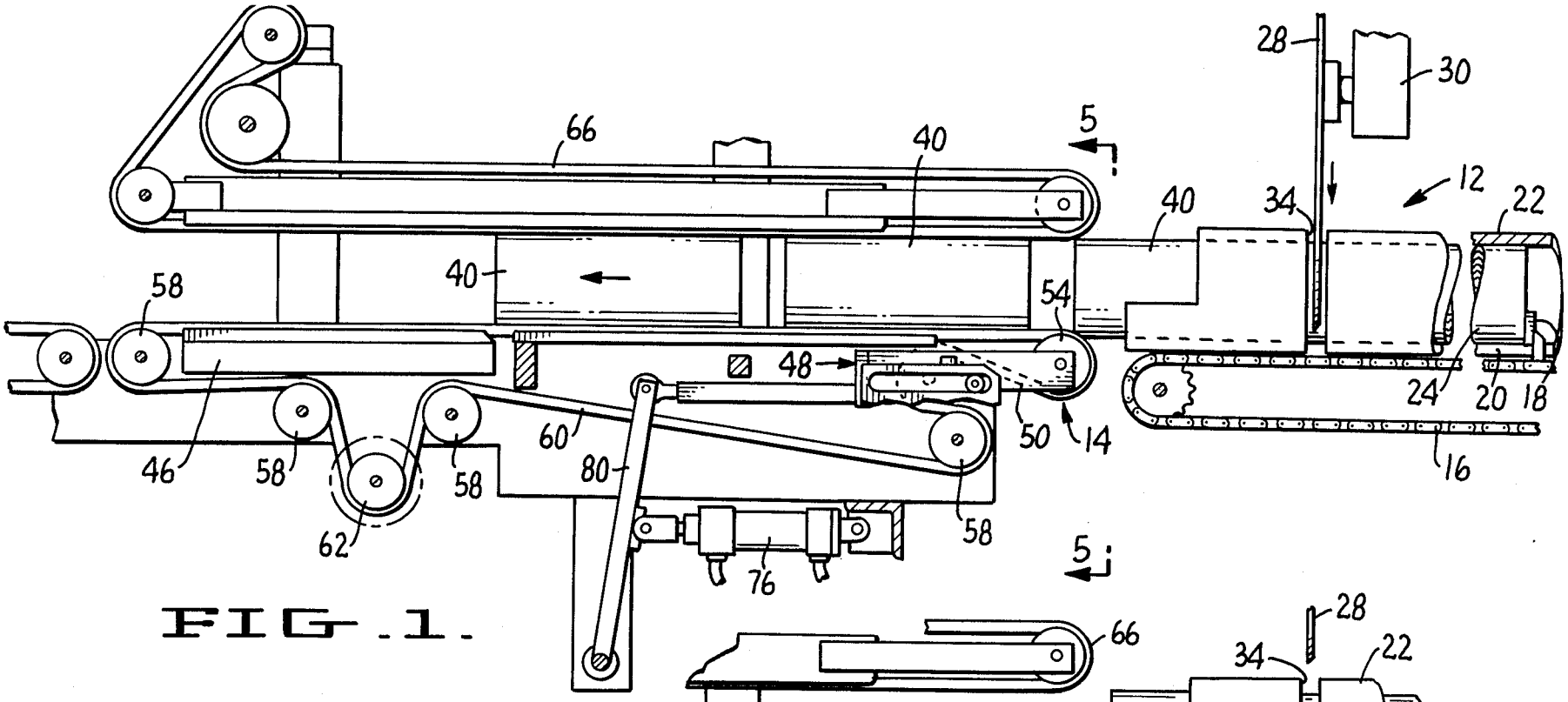
FIG. 1 is a side view of apparatus constructed in accordance with the present invention and showing the second conveyor means of the apparatus receiving individual roll segments from the first conveyor means.

Referring now to the drawings, the preferred form of apparatus constructed in accordance with the teachings of the present invention includes a first conveyor means indicated generally by reference numeral 12 and a second conveyor means designated generally by reference numeral 14. The first conveyor means includes a conveyor belt 16 to which a pusher arm 18 is connected. Pusher arm 18 projects through slot 20 formed at the bottom of an elongated cylindrically shaped housing 22. The housing accommodates in the interior thereof an elongated roll product or cant 24 which is pushed endwise through the housing by pusher arm 18 upon movement of conveyor belt 16. Any conventional prime mover (not shown) may be used to provide such movement. Preferably movement of the cant 24 is, as is conventional, accomplished in a stepwise manner with the distance of each step normally being equal to the length of the individual roll segments to be cut from the cant.

The roll segments, as is also conventional, are cut from the cant by a rotating circular saw or knife blade 28 which is operatively associated with a conventional blade drive mechanism 30 to sweep back and forth and cut the cant when transport thereof is halted in housing 22. Housing 22 defines a space 34 through which the blade 28 may sweep without contacting the housing.

With particular reference to FIG. 1 it may be seen that the individual roll segments 40 produced from the cant by the saw 28 are delivered from first conveyor means 12 to the second conveyor means 14 and the second conveyor means 14 transports the individual roll segments to a suitable downstream location where additional operations such as wrapping are carried out. Second conveyor means 14 includes a first conveyor section 46 and a second conveyor section 48 mounted for limited movement relative to the first conveyor section. More specifically, the second conveyor section 48 includes a movable frame 50 upon which are rotatably journaled sheaves 52 and 54. The fixed first conveyor section 46 also has a plurality of sheaves 58 rotatably mounted thereon. Second conveyor section 48 has two sets of the sheaves 52, 54 disposed in side-by-side relationship and first conveyor section 46 has two sets of the sheaves 58 also disposed side-by-side. Two parallel unitary belts 60 are threaded about sheaves 52, 54 and 58 in the manner illustrated. Additionally, such unitary belts 60 loop around a drive roll 62 connected to a prime mover (not shown) to rotate the belts in a counter clockwise direction as viewed in FIG. 1. Thus, when belts 60 are rotated about their supporting sheaves, the individual roll segments 40 supported thereby will move to the left as viewed in FIG. 1. If desired, an idler belt 66 may be disposed above belts 60 and in engagement with the individual roll segments to maintain them in position. In the arrangement illustrated, idler belt 66 is simply moved due to frictional engagement with the moving individual roll segments; however, it will be appreciated that belt 66 may be driven by a prime mover if desired.

Figure 2:
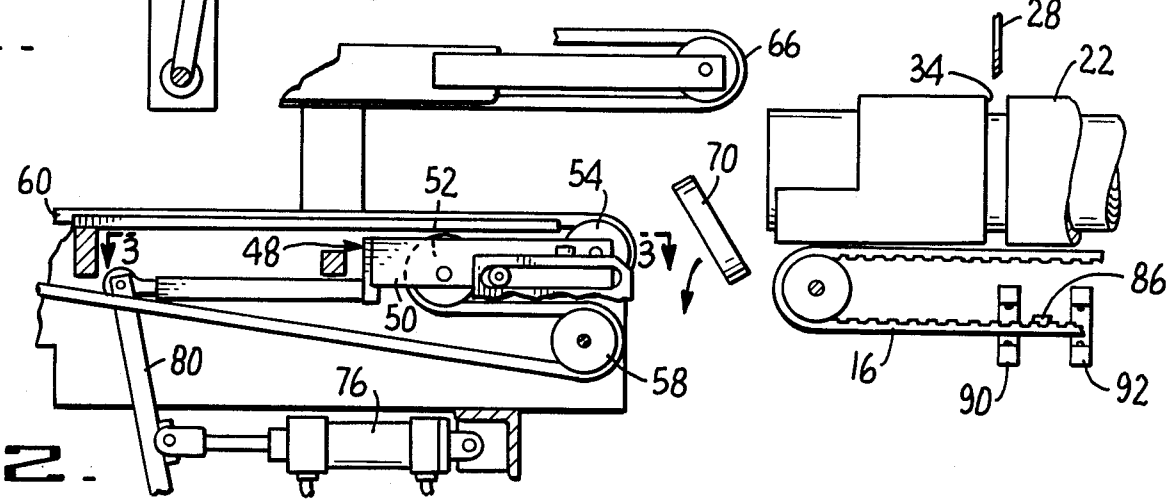
FIG. 2 is a sectional side view of the apparatus of FIG. 1 and showing a cant end being culled.
Figure 3:
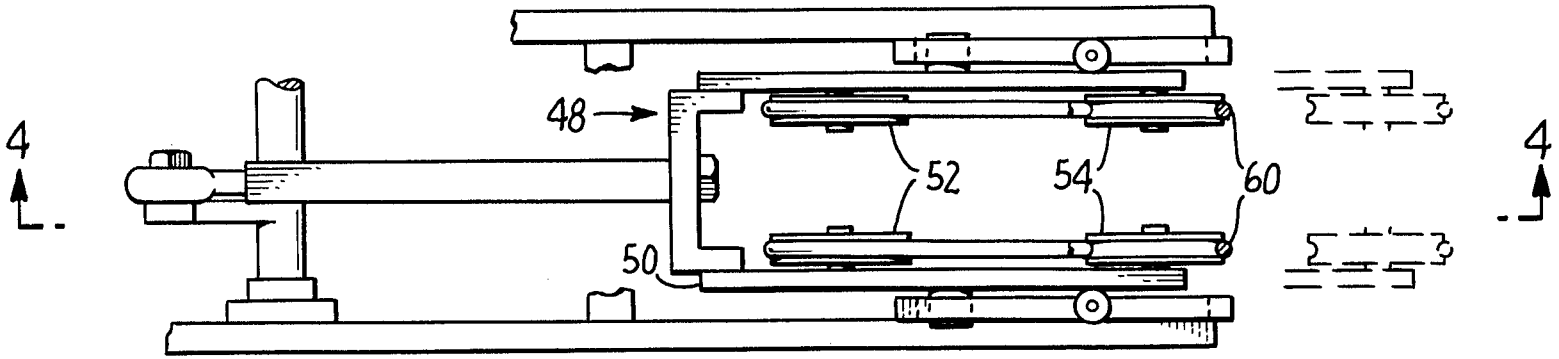
FIG. 3 is a cross sectional view taken along the line 3—3 in FIG. 2.
Figure 4:
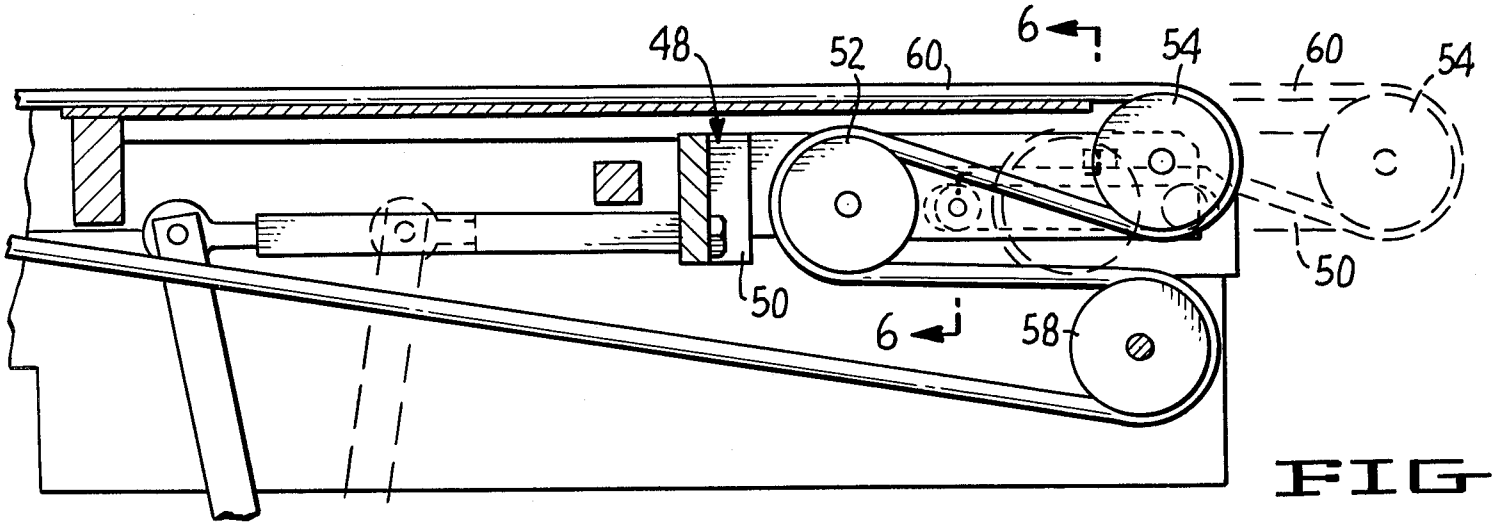
FIG. 4 is a cross sectional view taken along the line 4—4 in FIG. 3.
Figure 5:
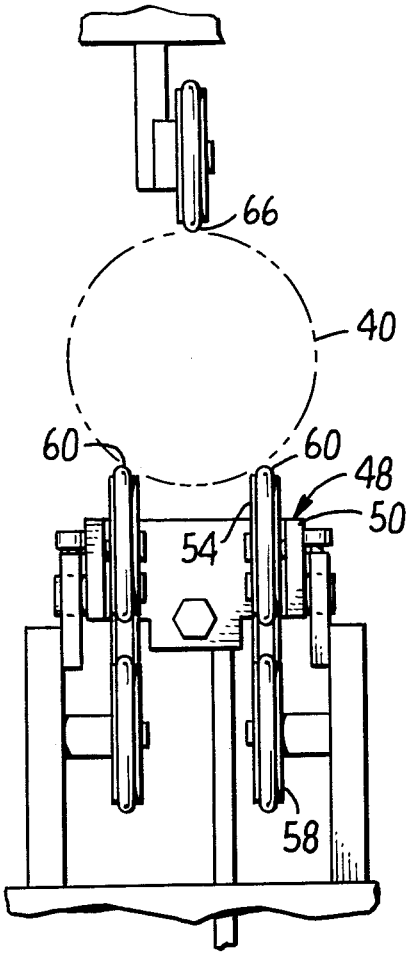
FIG. 5 is a cross sectional view taken along the line 5—5 in FIG. 1.
Figure 6:
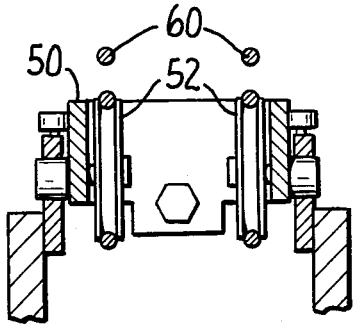
FIG. 6 is a cross sectional view taken along the line 6—6 in FIG. 4.
Figure 7:
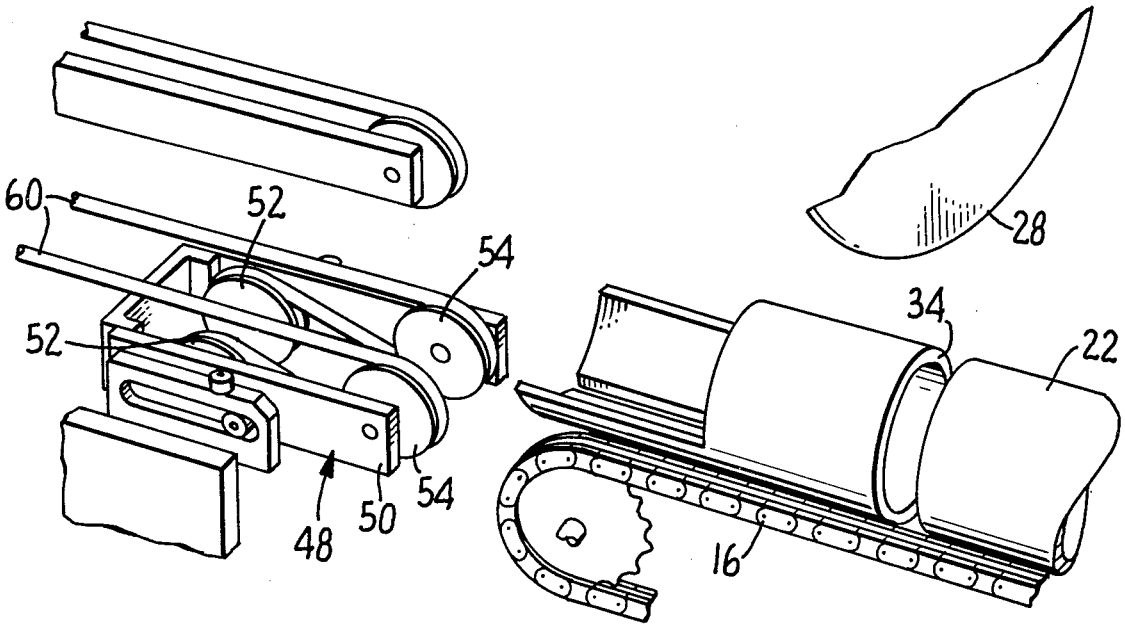
FIG. 7 is a perspective view of a selected portion of the apparatus.

As indicated above, cant cutting operations generally create cant ends which are to be culled for disposal or reprocessing. The present apparatus functions to cull said cant ends. This operation may perhaps best be seen with reference to FIGS. 2, 3, and 4. When a cant end 70 is positioned for transfer from the first conveyor means 12 to the second conveyor means 14, conveyor section 48 is moved relative to conveyor section 46 so that a gap is created between first conveyor means 12 and second conveyor means 14. In other words, the conveyor section 48 is retracted away from the first conveyor means 12. The gap thus created will enable the cant end 70 to fall downwardly under the force of gravity, preventing the cant end from being transferred to the second conveyor means 14. Any suitable means may be employed to create the gap. In the arrangement illustrated a pneumatic cylinder-piston arrangement 76 is the prime mover for accomplishing this end. Specifically, movement of the piston within the cylinder to the left as viewed in FIG. 2 will cause a counter clockwise movement of a crank arm connected to second conveyor section 48 thus moving the second conveyor section 48 to the left as shown in FIG. 2. Movement of the second conveyor section 48 is parallel to the upper run of unitary belts 60. The belts 60 will be maintained under continuous tension even during relative movement between the conveyor sections by virtue of the fact that any slack produced by such movement is taken up by the interaction of sheaves 52, 54 and 58 as shown in FIG. 2. After a cant end 70 has been culled the prime mover 78 will retract thus moving second conveyor section 48 into close proximity with the first conveyor means 12. The second conveyor means 14 will then be in position to receive the individual roll segments 40 without danger of the roll segments falling between the two conveyor means.

It will be appreciated that precise timing must be maintained between movement of the cant and movement of conveyor section 48 during the course of operation of the apparatus to insure that the gap is created when the cant ends are to be ejected from first conveyor means 12 and at no other time. An arrangement that has been found to be especially suitable for such purpose is the use of magnetic switches actuated by metal slugs attached to conveyor belt 16. One such slug 86 is shown in FIG. 2. Slug 86 as it moves to the right in said figure sequentially passes a magnetic switch 90 which actuates prime mover 76 and a magnetic switch 92 which deactivates said prime mover. The metal slugs must be attached to conveyor belt 16 in a precise relationship to pusher arm 18 attached to the conveyor belt whereby prime mover 76 will be successively actuated and deactuated at both ends of the cant 24 so that both cant ends are culled therefrom.

I claim:

1. Apparatus for culling cant ends cut from a cant at a cant cutting station comprising, in combination:

first conveyor means for transporting said cant endwise past said cutting station whereat said cant is cut into individual roll segments of a predetermined length and cant ends;

second conveyor means positioned downstream from said first conveyor means for receiving said roll segments and transporting said roll segments to a predetermined location; and means for forming a gap between said first and second conveyor means at the time said cant ends are positioned for transfer from said first conveyor means to said second conveyor means whereby said cant ends will fall through said gap and not be transferred to said second conveyor means, said first conveyor means including two conveyor sections mounted for relative movement, and said gap forming means including prime mover means for moving one of said conveyor sections relative to the other of said conveyor sections to form said gap, each of said sections including sheave means and means for rotatably supporting said sheave means, said first conveyor means further including unitary belt means disposed about sheave means on both said conveyor sections, said sheave means adapted to maintain said unitary belt means under continuous tension during relative movement between said conveyor sections.

2. The apparatus of claim 1 additionally comprising means for sensing when said cant ends are positioned for transfer from said first conveyor means to said second conveyor means, said sensing means operatively connected to said gap forming means to activate said gap forming means when said cant ends position is sensed.

3. The apparatus of claim 2 wherein said sensing means comprises an element carried by said first conveyor means and means for detecting the position of said element.

* * * * *